United States Patent [19]

Melocik

[11] 4,341,243

[45] Jul. 27, 1982

[54] PRESSURE REDUCING VALVE WITH FLOATING STEM FOR MAKE-UP VENT

[75] Inventor: Kurt B. Melocik, Mazon, Ill.

[73] Assignee: Caterpillar Tractor Co., Peoria, Ill.

[21] Appl. No.: 245,223

[22] PCT Filed: Jun. 16, 1980

[86] PCT No.: PCT/US80/00765

§ 371 Date: Jun. 16, 1980

§ 102(e) Date: Jun. 16, 1980

[87] PCT Pub. No.: WO81/03686

PCT Pub. Date: Dec. 24, 1981

[51] Int. Cl.[3] ..... F15B 13/042

[52] U.S. Cl. ..... 137/625.68; 91/438; 91/441; 91/451; 137/596.15; 137/596.2

[58] Field of Search ..... 91/438, 441, 451; 137/596.15, 596.2, 625.68

[56] References Cited

U.S. PATENT DOCUMENTS 3,698,415 10/1972 Forster et al. .
3,766,944 10/1973 Distler .
3,817,153 6/1974 Zunzer .
3,840,049 10/1974 Field .
3,987,703 10/1976 Latimer .
4,184,512 1/1980 Pignolet ..... 137/625.68 X

FOREIGN PATENT DOCUMENTS 2236101 1/1975 France ..... 137/596
1494400 12/1977 United Kingdom .

*Primary Examiner*—Gerald A. Michalsky
*Attorney, Agent, or Firm*—Wegner, Stellman, McCord, Wood & Dalton

[57] ABSTRACT

A fluid control system for controlling a fluid motor (12) wherein a pressure regulating pilot valve (10) controls a directional control valve (11) by manipulation of handle (21) associated with the pilot valve (10). The directional control valve (11) includes a make-up valve (84). The pilot valve (10) includes a spool (26) having a recess (98) providing selective communication between the backside of the movable valve member (86) of the make-up valve and an exhaust recess (100) communicating with the reservoir tank (36). A direct mechanical connection is provided from the handle (21) to the spool (26) as the result of an abutment of an upper end portion (102) of the spool (26) with a surface (49) on the plunger (28) engaged by the control handle in effecting the positive movement of the spool (26) to effect the desired communication between the recess (98) and recess (100). The spool normally is resiliently movable to effect a desired pressure regulation fluid flow through the pilot valve (10).

9 Claims, 2 Drawing Figures

PRESSURE REDUCING VALVE WITH FLOATING STEM FOR MAKE-UP VENT

DESCRIPTION

1. Technical Field

This invention relates to pressure regulating valve and in particular to pressure regulating valves for use in fluid systems requiring venting of a system component.

2. Background Art

In U.S. Pat. No. 3,840,049, of Jesse L. Field, Jr., which patent is owned by the assignee hereof, a control system for use in controlling positioning of a fluid motor is shown to include a directional control valve which is operated by a pilot valve so as to provide pressurized fluid selectively to opposite ends of a piston cylinder for suitably positioning the piston therein. The directional control valve includes a make-up valve which automatically opens a bypass passage between the fluid motor ports and a fluid return passage when necessary to prevent cavitation of the motor, such as may result from an overrunning condition from an external load force. The pilot valve is connected with a float valve which has a spool shifted by the fluid pressure against a spring bias in the normal operation of the system. When desired, the manual pilot valve is shifted to a float position.

In U.S. Pat. No. 3,766,944, of Josef Distler, a pilot-controlled fluid flow regulating valve is shown. The regulating valve includes a spool which is moved relative to a neutral position by fluid from a pilot valve. The regulating valve includes a manually operated handle for controlling the disposition of a piston mounted in the body of the pilot valve.

Other background patents of interest in connection with pressure regulating valves include those of Franz Forster et al U.S. Pat. No. 3,698,415; Egon Zunzer U.S. Pat. No. 3,817,153; Eugene E. Latimer U.S. Pat. No. 3,987,703, which patent is owned by the assignee hereof; and British Pat. No. 1,494,400 of Nordhydraulic AB, a Swedish corporation. The Zunzer patent shows a pressure reducing pilot valve used in another fluid control application. The Forster et al patent shows a pressure regulating valve wherein the control member bears upon the valve body via plurality of springs, at least one of which comes into play only after the control member has been displaced through a predetermined extent. The Forster et al patent shows a regulating pilot valve similarly used in a different system application.

In the Latimer patent, the pilot-controlled hydraulic system has a load-supporting cylinder with a valve assembly operative to automatically provide an emergency source of pilot pressure upon failure of the main pilot system. The control utilized pressurized fluid from the load-supporting motors for pilot operation of the system for emergency lowering of te load.

In the British patent, a regulating pilot valve provides an output under certain conditions so as to throw another valve to either of two different extreme positions.

While the background art patents discussed above show different forms of pressure regulating valves such as used in load-lifting fluid systems, the structures thereof are relatively costly and complex and do not provide the improved, simplified construction of the present invention.

DISCLOSURE OF INVENTION

The present invention is directed to overcoming one or more of the problems as set forth above.

In one aspect of the present invention, the invention comprehends an improved control for providing a venting function as a result of a novel arrangement of a pressure regulating pilot valve.

In the present invention, the venting function is produced by direct mechanical connection between the connector from the handle to the spool of the pilot valve.

The spool of the pilot valve is normally spring-biased to provide the desired pressure regulating function. The valve, however, is arranged so that, under conditions wherein venting of the control valve of the system is desired, the biasing spring is overcome to permit the desired direct connection between the control handle and spool valve, permitting the operator to positively move the spool valve to an arrangement wherein the desired venting connection is effected.

In the illustrated embodiment, the spool valve is provided with an annular groove which is brought into alignment with an opening to tank which is normally closed by a portion of the spool valve during the pressure regulating functioning thereof. The connection between the annular recess and the tank opening provides a communication to other portions of the system so as to effect the desired venting action.

In the illustrated embodiment, the venting of the make-up valve of the system permitting the load supported by the fluid motor to float.

More specifically, the invention comprehends an improved pressure regulating valve having wall means defining a valve chamber provided with an inlet and an outlet, a movable valve member in the chamber, and regulating means associated with the valve chamber and the movable valve member to provide pressure regulation of fluid passing from the inlet through the valve chamber to the outlet, the regulating means being arranged to move the valve member to a first position in response to pressurized fluid in the outlet. The pressure regulating valve has a second inlet and an exhaust passage in communication with the chamber. The valve has a mechanical means for overriding the regulating means and moving the valve member to a second position at which the second inlet is in fluid communication with the exhaust passage.

The improved valve is advantageously adapted for use in a fluid system having a reciprocable fluid motor, and fluid supply means including a directional control valve for controlling delivery of pressurized fluid to the motor for reciprocally operating the same.

In the illustrated embodiment, the pressure regulating valve includes first and second passage means in the wall means thereof and recess means associated with the movable valve member communicating between the first and second passage means when the valve member is in the second preselected position.

In the illustrated embodiment, the transfer passage means is defined by an annular recess on the movable valve member.

Thus, the pressure regulating valve and system apparatus of the present invention are extremely simple and economical of construction while yet providing the highly desirable advantages discussed above.

BEST MODE FOR CARRYING OUT THE INVENTION

Figure 1A:
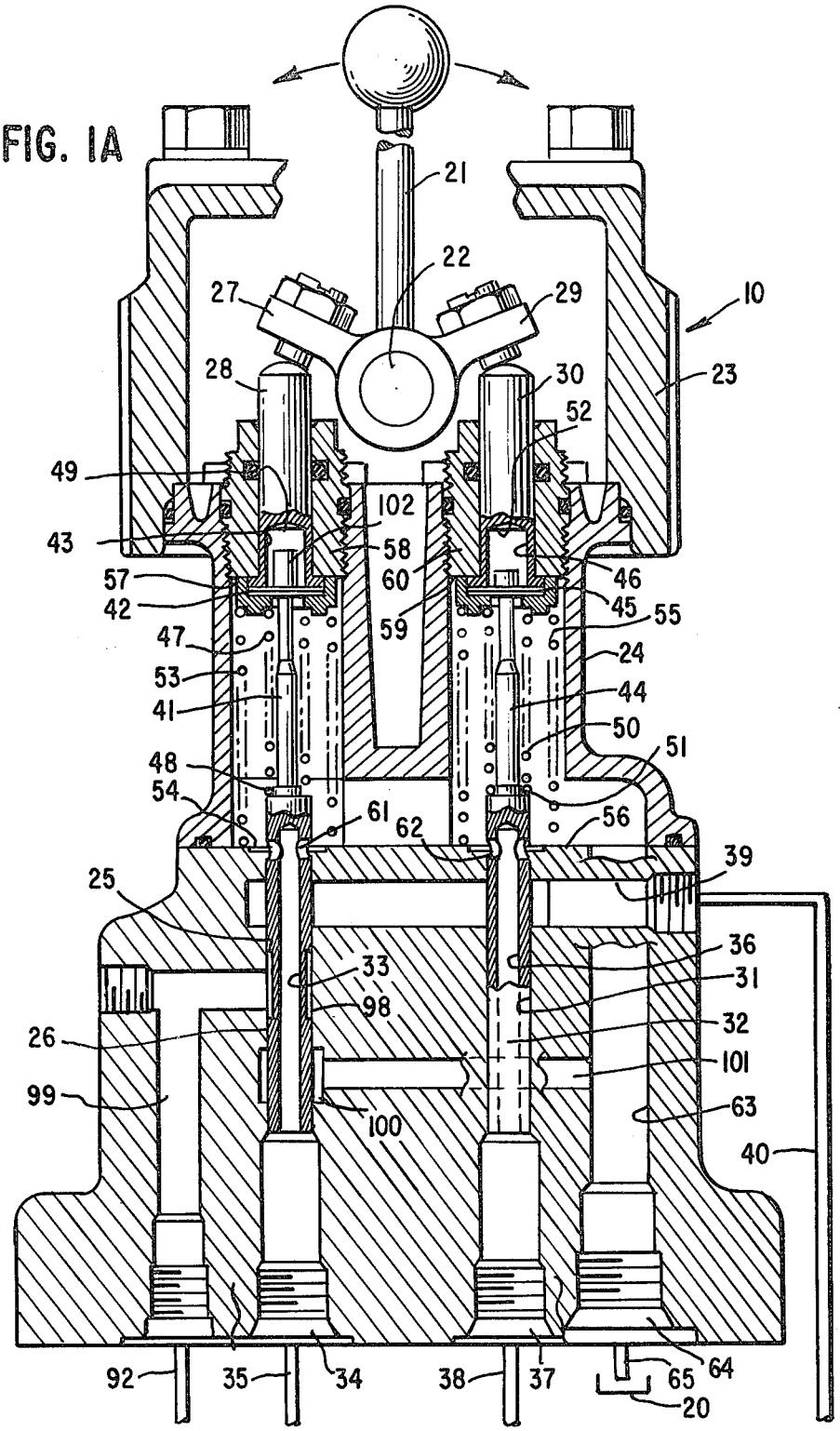
FIG. 1A is a portion of a fluid system having a pressure regulating valve embodying the invention.
Figure 1B:
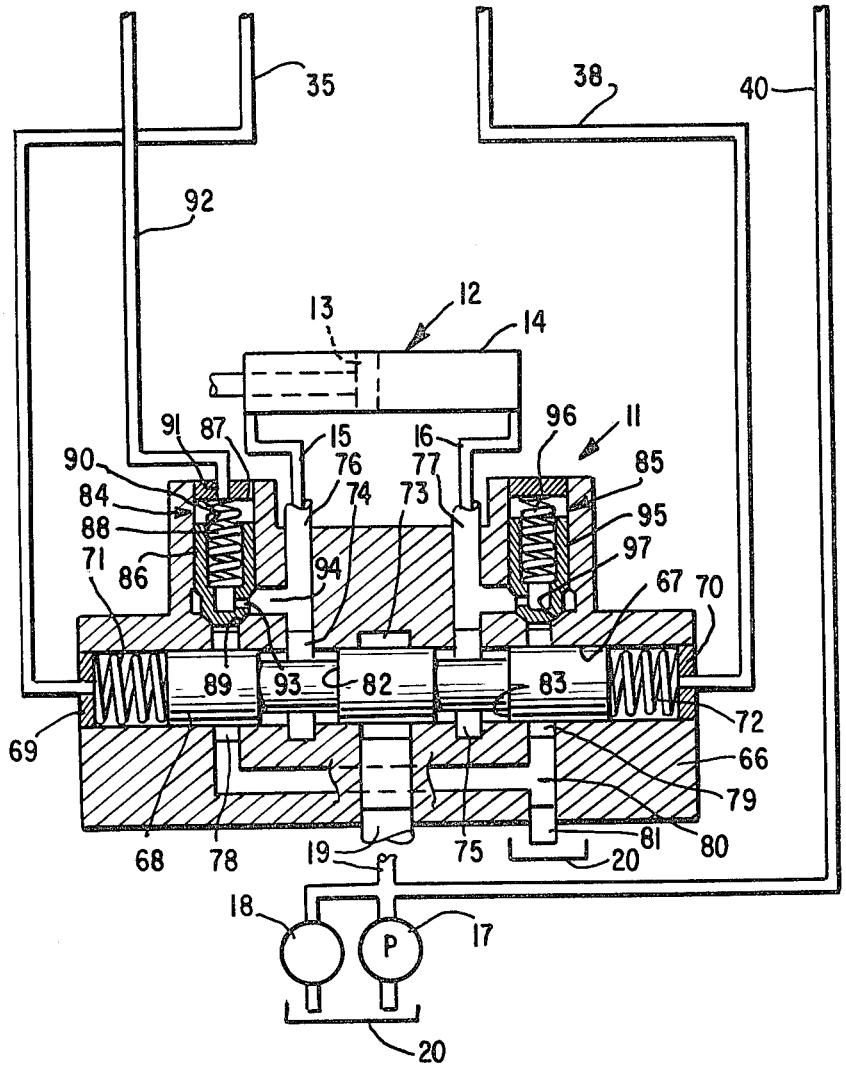
FIG. 1B is a continuation of the FIG. 1A portion of the drawing and showing the connection of the directional control valve to the fluid motor in the fluid system.

In the exemplary embodiment of the invention as disclosed in the drawing, a pressure regulating valve generally designated 10 is provided for use with a directional control valve 11 in controlling delivery to a fluid motor 12 having a piston 13 reciprocable in a cylinder 14. Pressurized fluid is delivered to the opposite ends of cylinder 14 through a first supply line 15 and a second supply line 16, as shown in FIG. 1B. The fluid motor is exemplary only, it being obvious that other forms of fluid motors, as well as a plurality thereof, may be used interchangeable with the disclosed motor.

Pressurized fluid for actuation of the fluid motor is provided normally from a high pressure pump 17 having the output pressure thereof regulated by a suitable relief valve 18 connected between the high pressure outlet conduit 19 from pump 17 and the tank reservoir 20 for controlling the fluid pressure in the system.

Directional control valve 11 is operated by the pressure regulating valve which effectively defines a pilot valve. The pilot valve is controlled by a manually operable handle 21. Thus, as seen in FIG. 1A, the handle is swingable about a pivot 22 so as to urge a first actuating arm 27 against a plunger 28 and a second actuating arm 29 against a plunger 30 of the pilot valve. The handle is swingable within a housing 23 carried on wall means 24 defining the valve body.

Valve body 24 defines a first valve chamber 25 receiving a first movable valve member or spool 26, and a second valve chamber 31 receiving a second movable valve member, or spool 32.

Spool 26 defines an axial, downwardly opening bore 33 communicating with an outlet port 34 connected to a transfer conduit 35. Spool 32 defines a similar axial bore 36 opening to an outlet port 37 connected to a transfer conduit 38.

Valve body 24 further defines a cross bore defining an inlet passage 39 connected through a supply conduit 40 to the pump 17.

As shown in FIG. 1A, spool 26 is provided with a stem 41 which extends upwardly through a connector 42 into a recess 43 at the lower end of plunger 28. Similarly, spool 32 is provided with an upwardly extending stem 44 extending through a connector 45 into a recess 46 in the lower end of plunger 30. A first coil spring 47 extends between connector 42 and a shoulder 48 on spool 26 for biasing the spool resiliently downwardly relative to connector, thereby spacing the upper end of the stem 41 from the inner wall surface 49 of the recess 43. Similarly, a coil spring 50 extends between the connector 45 and a shoulder 51 on the spool 32 to bias the spool downwardly and space the upper end of the stem 44 from an inner wall surface 52 of the recess 46.

The connector 42 is biased upwardly by a coil spring 53 extending between the connector and a shoulder 54 on the valve body. Similarly, a second spring 55 biases the connector 45 upwardly, spring 55 extending between connector 45 and a shoulder 56 on the valve body. Thus, connector 42 is normally urged against a shoulder 57 of a plug 58 slidably carrying the plunger 28, and connector 45 is urged against a shoulder 59 on a plug 60 slidably carrying plunger 30.

Spool 26 is provided with radial ports 61 opening to axial passage 33 and spool 32 is provided with radial ports 62 opening to passage 36. As shown in FIG. 1A, ports 61 and 62 are normally spaced from the inlet passage 39. However, when plunger 28 or plunger 30 is suitably depressed by manipulation of handle 21, the corresponding connector 42 or 45 is moved downwardly against the action of spring 53 or spring 55, respectively, so as to permit the spools 26 and 32 to be resiliently moved downwardly by the action of the biasing springs 47 and 50, respectively. Thus, illustratively, when the handle 21 is swung to the left, as seen in FIG. 1A, so as to depress plunger 28, spool 26 may be moved sufficiently downwardly to provide communication between the inlet passage 39 and the radial port 61, thereby conducting pressurized fluid from the pump and supply conduit 40 through the passage 33 of spool 26, outlet 34 and transfer conduit 35 to the directional control valve 11. The pressure of the fluid in outlet port 34 acting on the end of spool 26 opposes the bias of springs 47 to position the spool 26 to a first preselected position in response to fluid pressure in outlet port 34. An instantaneous preselected pressure level in outlet port 34 as established by the degree of input through handle 21 remains constant because any change of pressure in the outlet port 34 would result in an unbalance of force opposing the spring 47 resulting in movement of spool 26 to open or close ports 61. This maintains the force balance between spring 47 and the force created by fluid pressure in the outlet port 34 acting on the end of spool 26. This action provides a pressure regulating function of the valve 10. A similar action occurs relative to port 62 of spool 32 so as to provide pressure regulated fluid through transfer conduit 38 as a function of the positioning of handle 21 in a clockwise direction, as seen in FIG. 1A.

As further shown in FIG. 1A, valve body 24 further defines an exhaust passage 63 connected through an exhaust port 64 and a conduit 65 to the tank reservoir 20. In the retracted position of the spools 26 and 32, the ports 61 and 62 thereof are in communication with the exhaust passage so that normally conduit 35 and 38 are vented when the handle 21 is in the neutral, centered position of FIG. 1A.

Referring now more specifically to FIG. 1B, the directional control valve 11 defines a spool valve having a body 66 defining a valve chamber 67 in which is reciprocally mounted a spool 68. Conduit 35 opens through a closure 69 to one end of the chamber 67, and conduit 38 opens through a closure 70 through the opposite end of the chamber.

Spool 68 is centered in valve chamber 67 by a first biasing spring 71 extending between closure 69 and one end of the spool and a second biasing spring 72 extending between closure 70 and the opposite end of the spool. High pressure supply conduit 19 is connected through the valve body 66 to an annular recess 73 at the midportion of chamber 67. A second annular recess 74 is spaced axially toward closure 69 from annular recess 73 and a second annular recess 75 is spaced axially in the opposite direction from the recess 73. Recess 74 is connected through a passage 76 to the fluid supply line 15 and recess 75 is connected through a passage 77 to the fluid supply line 16.

Outboard of annular recess 74, the valve body is provided with an exhaust annular recess 78 and outboard of the recess 75, the valve body is provided with a second annular exhaust recess 79. The exhaust recesses are connected through an exhaust passage 80 and exhaust conduit 81 to the reservoir tank 20.

Spool 68 is provided with a first annular, radially outwardly opening recess 82 which is in communication with body recess 74 and spaced from body recess 73 in the centered arrangement of the control valve 11, as shown in FIG. 1B. The spool is provided with a second annular, radially outwardly opening recess 83 in communication with recess 75 and out of communication with recess 73 when the spool is in the centered position of FIG. 1B.

Directional control valve 11 further defines a pair of make-up valves 84 and 85, respectively. Make-up valve 84 is defined by a movable valve member 86 received in a valve chamber 87 in valve body 66 and is normally biased by a spring 88 into seated relationship with a valve seat 89 opening to the recess 78. The valve member 86 defines an axial passage 90 in communication with a port 91 in the valve body connected to a conduit 92. The valve member further defines a port 93 opening to a valve chamber 94 communicating with the passage 76.

Make-up valve 85 is generally similar to make-up valve 84 except for the omission of the port 91 and conduit connection 92. Thus, make-up valve 85 includes a valve member 95 biased by a spring 96 against a valve seat 97.

In the normal operation of the fluid system, delivery of the pressurized fluid to motor 12 is effected by suitable movement of the spool 68 of directional control valve 11 by selectively providing pressurized fluid through the pilot valve 10 and either of control conduits 35 or 38. Thus, if it is desired to move the fluid piston 89 opening 13 of fluid motor 12 to the right, as seen in FIG. 1B, the suitable manipulation of handle 21 of the pilot valve as shown in FIG. 1A, is effected to provide pressurized fluid through the spool passage 33 to the transfer conduit 35, thereby applying pressure to the lefthand end of spool 68 of valve 11 and moving recess 82 to the right so as to provide communication between recess 73 and recess 74, thereby providing pressurized fluid from conduit 19 through the control valve to the supply line 15. At the same time, recess 83 is moved into communication with recess 79 so as to provide an exhaust connection from line 16 through the directional control valve to the exhaust conduit 81 and tank reservoir 20.

Conversely, when it is desired to move the piston 13 to the left, as seen in FIG. 1B, pilot control handle 21 is moved in a clockwise direction so as to provide communication between supply passage 39 and spool passage 36 through port 62, thereby providing pressurized fluid through the transfer conduit 38 to the righthand end of the directional control valve, thereby moving spool 68 to the left and positioning recess 83 so as to have communication between recess 73 and recess 75 of the valve body, thereby providing pressurized fluid from conduit 19 through passage 77 to transfer conduit 16. At the same time, spool recess 82 is moved into communication with recess 78 and recess 74 of the valve body to provide an exhaust passage from conduit 15 to the exhaust conduit 81.

Thus, valve 10 functions as a pressure regulating pilot valve for selectively moving the spool 68 of the directional control valve 11 as a function of the movement of handle 21 of the pilot valve. Make-up valves 84 and 85 are provided for effectively preventing cavitation of the fluid motor 12 such as when the load forces thereon tend to cause the piston 13 to move more rapidly than the flow of fluid from the pump 17 can provide through the lines 15,16. If for example, the cylinder 14 is retracting rapidly as noted above during a lowering condition, the pressure in line 15 and passage 76 would drop. This drop in pressure is also felt in valve chamber 87 via valve chamber 94 and port 93. When the pressure in passage 76 drops below the tank pressure in exhaust passage 80 and annulus 78, the difference of pressure will act on the end of valve member 86 lifting it from its seat 89 thus providing make-up fluid to the cylinder 14 through passage 76 end line 15. Resultingly, fluid from conduit 16 is transferred through the drain passage 80 into recess 78 and, thus, into the passage 76 as a result of the unseating of valve member 86 from seat 89 to augment the fluid flow to the conduit 15 and, thus, effectively prevent cavitation of the motor 12.

As indicated briefly above, the improved pressure regulating pilot valve 10 is arranged to provide an improved means for permitting the system to operate in a float condition wherein the piston 13 may float in the cylinder 14. To effect such a float control, the pilot valve 10 is arranged to vent the make-up valve 84 and maintain spool 68 in its shifted position so that pressurized fluid can move past the make-up valve and allow intercommunication between the pump, tank and cylinder lines.

To this end, spool 26 is provided with an annular, radially outwardly opening recess 98 which is in communication with a flow passage 99 in the valve body 24 to which conduit 92 is connected. The valve body defines a radially inwardly opening annular recess 100 spaced from passage 99. During normal pressure regulating reciprocation of spool 26, recess 98 is maintained in space relationship to recess 100.

As shown in FIG. 1A, recess 100 is connected through a passage 101 to the exhaust passage 63. When it is desired to vent the make-up valve 84, spool 26 is moved to a position wherein recess 98 communicates with recess 100 so as to connect conduit 92 to exhaust passage 63 and, thus, through conduit 65 to reservoir tank 20, thereby venting the backside of valve member 86 and permitting the make-up valve 84 to open so that the fluid may pass into conduit 15.

Movement of recess 98 into communication with recess 100 is effected by a direct mechanical connection between handle arm 27 and spool 26. The direct mechanical connection is effected by movement of plunger 28 downwardly to bring the plunger surface 49 into engagement with the upper end portion 102 of spool 26. Resultingly, downward movement of arm 27 and concurrent downward movement of plunger 28 causes a direct downward movement of spool 26 so as to move recess 98 into communication with recess 100 against the upward biasing action of spring 53.

Thus, the provision of recess 98 in spool 26 and the connection between the backside of make-up valve 84 through conduit 92 to this recess for selectively exhausting the valve through the exhaust recess 100, passage 101, and passage 63 of the pilot valve 10 effects a simple, low cost float control of the fluid motor eliminating costly and complicated additional valving and fluid circuitry of the conventional systems.

INDUSTRIAL APPLICABILITY

The control system of the present invention is advantageously adapted for a wide range of industrial applications. Illustratively, the fluid motor 12 may be utilized in connection with a wide range of apparatuses requiring a float position. In one example, a loader may be utilized to push the bucket thereof along the surface of the ground. On uneven surfaces, it is desirable to permit the bucket to follow the contour of the ground. Provision of a float operation in the control system permits the bucket to more effectively follow the contour.

The present invention utilizes one of the make-up valves of the directional control valve, which is normally provided to control cavitation of the motor, as a means for providing the desirable float condition.

Other aspects, objects and advantages of this invention can be obtained from a study of the drawings, the disclosure and the appended claims. The foregoing disclosure of specific embodiments is illustrative of the broad invention concepts comprehended by the invention.

What is claimed is:

1. A pressure regulating valve (10) having wall means (24) defining a valve chamber (25) provided with an inlet (39), an exhaust passage (101,63,64), and an outlet (34), a movable valve member (26) in said chamber (25), and regulating means (61,39,47) associated with said valve chamber and said movable valve member to provide pressure regulation of fluid passing from said inlet (39) through said valve chamber (25) to said outlet (34), said regulating means being further arranged to limit movement of said valve member (26) to a first preselected position in response to pressurized fluid in said outlet (34), the improvement comprising:

means (102,49,28) selectively directly mechanically connected with said movable valve member (26) for moving the movable valve member beyond said first position to a second preselected position;

means defining a second inlet (99);

means (99,98,100) operable when said valve member (26) is disposed in said second preselected position for providing a flow passage from said second inlet through said pressure regulating valve (10) to said exhaust passage, said regulating means (61,39,47) including a connector (42) slidably connected to said valve member (26), and a spring (47) positioned between the connector and said valve member, and said mechanical means (102,49,28) including an end portion (102) on said valve member, a manual input element (28) in engagement with said connector and having a contact surface (49) spaced from said end portion (102) of the valve member at the first position of the valve member and in contact with said end portion at the second position.

2. The pressure regulating valve (10) of claim 1 wherein said means operable when said valve member (26) is disposed in said second preselected position has a direct mechanical connection to said movable valve member (26) at that time.

3. The pressure regulating valve (10) of claim 1 wherein said means operable when said valve member (26) is disposed in said second preselected position comprises manually operable means.

4. A pressure regulating valve (10) having wall means (24) defining a valve chamber (25) provided with a first inlet (39) and an outlet (34), a movable valve member (26) in said chamber (25), and regulating means (61,39,47) associated with said valve chamber and said movable valve member to provide pressure regulation of fluid passing from said inlet (39) through said valve chamber (25) to said outlet (34), said regulating means being arranged to move said valve member (26) to a first position in response to pressurized fluid in said outlet (34), the improvement comprising:

said pressure regulating valve (10) having a second inlet (99) and an exhaust passage (101) in communication with said chamber (25), mechanical means (102,49,28) for overriding said regulating means (61,39,47) and moving said valve member (26) to a second position at which said second inlet (99) is in fluid communication with said exhaust passage (101), said valve being provided for use in a fluid system having a source (17) of fluid pressure, a tank (20), a fluid motor (12), a pilot-operated directional control valve (11) having a motor port (15,16), and a make-up valve (84,85) positioned between the motor port and the tank, said make-up valve having a vent port (91) for venting the make-up, said inlet (39) being connected to said source (17), said outlet (34) being connected to said pilot-operated directional control valve (11), and said second inlet (99) being connected to said vent port (91) and providing communication between the vent port and the exhaust passage (101) at the second position of the valve member (26).

5. The pressure regulating valve (10) of claim 4, wherein said second inlet (99) is blocked from fluid communication with said exhaust passage (101) in said first position of said valve member (26).

6. The pressure regulating valve (10) of claim 4 wherein said vent port (91) is blocked from fluid communication with said exhaust passage (101) at said first position of said valve member.

7. The pressure regulating valve (10) of claim 4 further including second passage means (100) in said wall means (24) and transfer passage means (98) associated with said movable valve member (26) communicating between said second inlet (99) and second passage means (100) when said valve member (26) is in said second preselected position.

8. The pressure regulating valve (10) of claim 7 wherein said transfer passage means (98) is disposed in said movable valve member (26).

9. The pressure regulating valve (10) of claim 4 wherein said movable valve member (26) comprises a spool defining an annular passage (98) communicating between said second inlet (99) and a second passage means (100) when said valve member (26) is in said second preselected position.

* * * * *